United States Patent [19]

Fort et al.

[11] 4,073,335

[45] Feb. 14, 1978

[54] COOLING DEVICE FOR IRON PIPE CENTRIFUGAL CASTING MACHINE

[75] Inventors: Pierre Henri Marie Fort, Nancy; Michel Pierrel, Pont-A-Mousson, both of France

[73] Assignee: Pont-A-Mousson S.A., Nancy, France

[21] Appl. No.: 727,098

[22] Filed: Sept. 27, 1976

Related U.S. Application Data

[63] Continuation of Ser. No. 564,190, April 1, 1975, abandoned.

[30] Foreign Application Priority Data

Apr. 1, 1974 France ..... 74 11569

[51] Int. Cl.[2] ..... B22D 13/02

[52] U.S. Cl. ..... 164/154; 164/118; 164/297

[58] Field of Search ..... 164/114, 118, 292, 297, 164/298, 348, 154, 126

[56] References Cited

U.S. PATENT DOCUMENTS

| | | | |
|---|---|---|---|
| 2,252,219 | 8/1941 | Trotzke | 164/297 X |
| 2,797,459 | 7/1957 | Myers | 164/297 X |
| 3,339,624 | 9/1967 | Cowgill | 164/348 X |
| 3,915,216 | 10/1975 | Fekete et al. | 164/154 X |

*Primary Examiner*—Francis S. Husar
*Assistant Examiner*—Gus T. Hampilos
*Attorney, Agent, or Firm*—Sughrue, Rothwell, Mion, Zinn and Macpeak

[57] ABSTRACT

The device comprises cooling water spraying systems extending throughout the length of the mould for cooling the latter. At least one additional local cooling water spraying element is slidably mounted on a guide bar through a slide. The bar is parallel to the mould and the local spraying element is adjustable in position on the bar for each casting for further cooling a selected part of the mould.

12 Claims, 4 Drawing Figures

COOLING DEVICE FOR IRON PIPE CENTRIFUGAL CASTING MACHINE

This is a continuation of application Ser. No. 564,190, filed Apr. 1, 1975, now abandoned.

The present invention relates to machines for centrifugally casting iron pipes and more particularly to devices in said machines for cooling the casting moulds of the type comprising cooling liquid or water spraying systems throughout the length of the mould.

The Applicant has found that after one or more castings of iron certain regions of the mould may be abnormally hot notwithstanding a theoretically uniform distribution along the mould of the jets of water issuing from the spraying systems. Now, it is known that the iron cast in the mould acquires after cooling a structure which depends on the rate of this cooling and therefore on the temperature of the mould. This structure consequently has heterogeneities corresponding to the abnormally hot regions of the mould. In particular, the degree of graphitization of the iron may be higher in the relatively colder regions. Consequently, some of the pipes cast may have to be rejected.

The same remarks apply to the case where the moulds are provided internally with a refractory lining containing a mixture of silica and bentonite: this type of lining which is termed a "wet spray" and permits avoiding the necessity of an annealing of the pipe after casting, is also affected by the degree of uniformity of the mould temperature.

An object of the invention is to provide a device for cooling a mould for centrifugally casting iron pipes by spraying water which overcomes in a simple manner the local variations in temperature of the mould and permits, in the case where the mould is provided with a "wet spray" coating, achieving a uniform quality of this coating.

According to the invention, there is provided a cooling device of the aforementioned type further comprising at least one guide bar parallel to the mould on which there is slidably mounted at least one slide whose position is adjustable along said bar for each casting and which carries an additional local cooling water spraying element.

With this arrangement, it is possible to employ the cooling by spraying of water with excellent results as concerns the quality of the pipe cast.

Further features and advantages of the invention will be apparent from the ensuing description given merely by way of example with reference to the accompanying drawings, in which.

Figure 1:
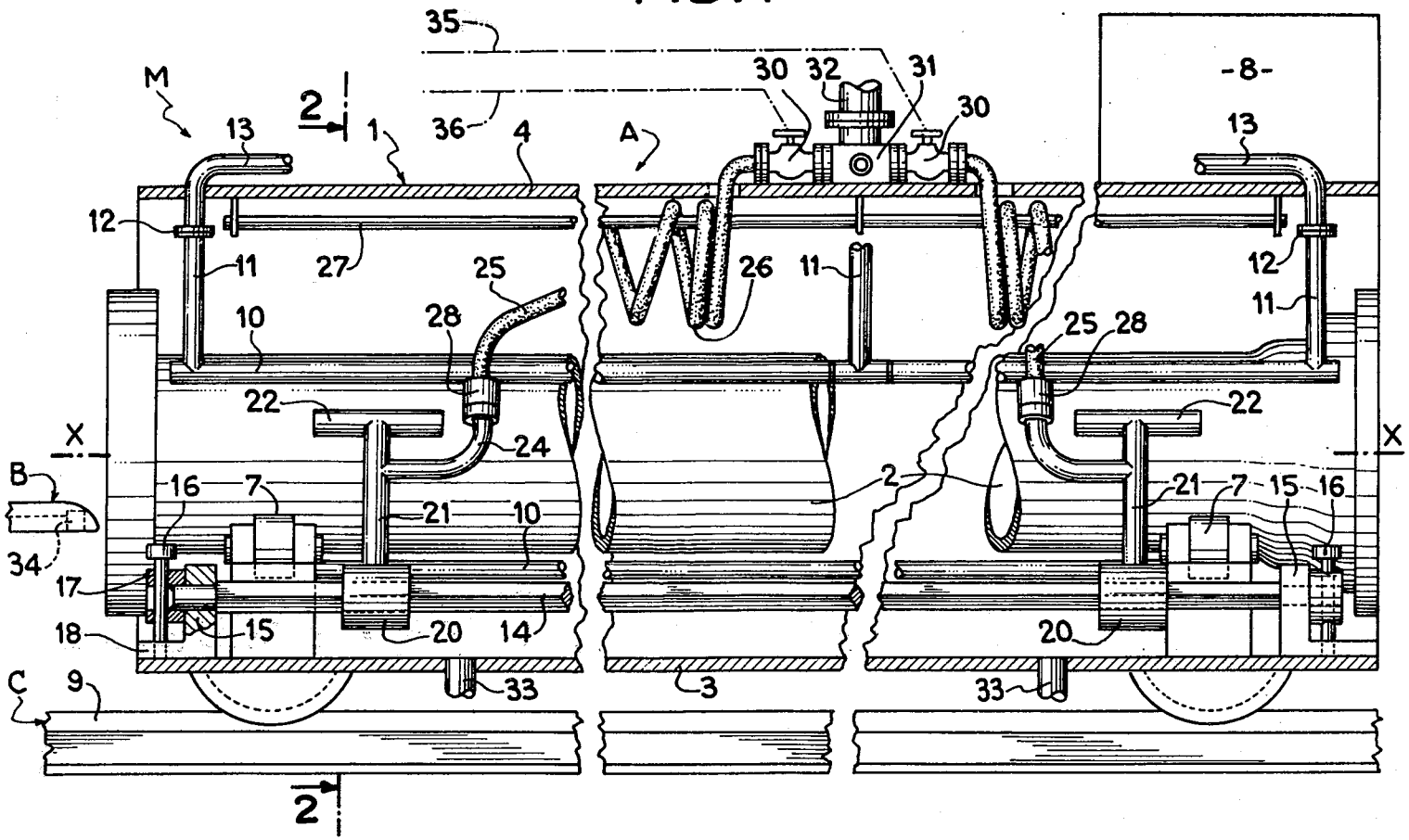
FIG. 1 is a diagrammatic view, partly in section, of a centrifugal casting machine equipped with a cooling device according to the invention.

In the embodiment shown in the drawings, the invention is applied to a machine M for centrifugally casting iron pipes. This machine comprises a carriage A which is movable in translation between a pouring channel B and an extracting device for the cast pipes (not shown) which is located at the opposite end of a runway C for the carriage A.

Figures 2, 3, 4:
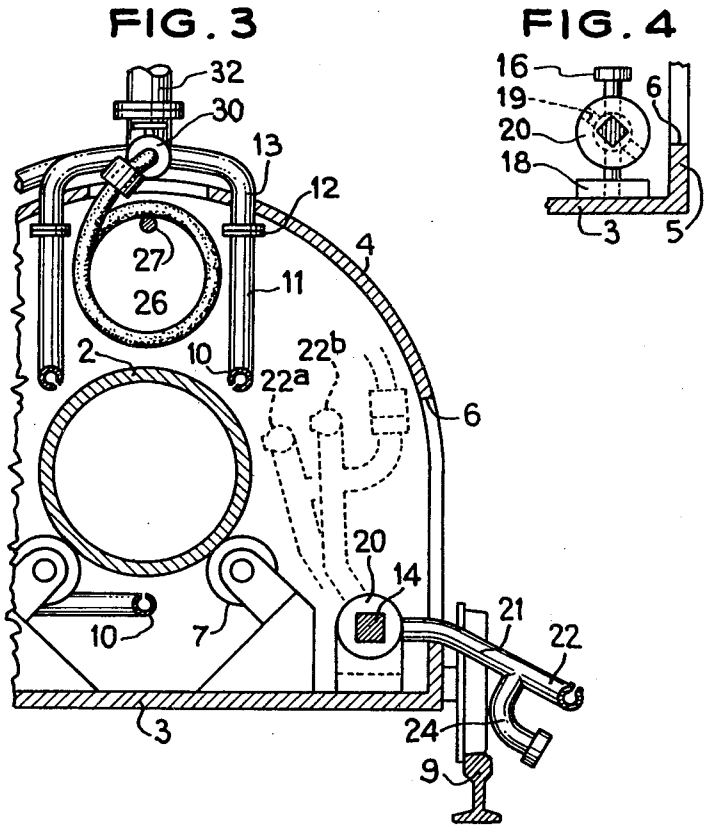
FIG. 2 is a cross-sectional view, taken on line 2—2 of FIG. 1, of the cooling device which is shown in its operative position.
FIG. 3 is a partial view similar to FIG. 2 in which the cooling device is shown in its withdrawn position of rest.
FIG. 4 is a sectional view of a detail of the cooling device.

In the known manner, the carriage A comprises a casing 1 in which there is disposed a mould 2 having an axis X—X. The casing 1 comprises a lower platform 3, an arched roof 4 connected on each side to the platform 3 by lateral walls 5. One of the walls 5 comprises detachable panels so as to open a lateral opening 6 which extends throughout the length of the casing (FIG. 3). The mould is supported by rolling rollers 7 which are driven in rotation by a motor 8. The assembly can be moved in translation along rails 9, defining the runway C, by a pneumatic jack (not shown).

Three water spraying systems 10 whose length corresponds to that of the mould 2 are disposed longitudinally in the casing 1 in the vicinity of the outer surface of the mould. Two of these systems are located above the mould on each side of a vertical plane containing the axis X—X and the third system is disposed under the mould in this vertical plane. The systems 10 are provided at their ends with water inlet and outlet pipes which are detachably connected by flanges 12 to pipes 13 which extend through a wall of the casing and are connected to a water supply pipe.

The casing 1 also carries in its lower part a longitudinally-extending guide bar 14 laterally disposed in the vicinity of the detachable lateral wall 5 parallel to the axis X—X and to the spraying systems 10. The guide bar 14 has, for example, a square section and is rotatable about its axis in end support bearings 15. It can be maintained in different angular positions by means of a pin 16 which extends through a ring 17, fixed to each end of the bar 14, and through a fixed plate 18 secured to the platform 3 (FIG. 4). A pin 16, a ring 17 and a plate 18 are provided near each bearing 15. Each ring 17 has at least two diametral apertures 19 which afford different angular orientations for the pin 16 so that it is possible to give the guide bar 14 at least two orientations. Slidably mounted on the bar 14 are two slides 20 having a section corresponding to the section of the bar 14, that is to say a hollow square section. Each slide 20 carries a rigid upright pipe 21 provided at its upper end with an additional local water spraying element 22. The latter is constituted by a short pipe which extends in a direction parallel to the axis X—X of the mould 2 and carries a plurality of spraying nozzles or jets 23. In the operative position shown in FIG. 2, this spraying pipe is slightly above the axis X—X of the mould and near to the surface of the latter, the jets 23 being directed toward this surface.

Communicating with the rigid pipe 21 is a rigid bent pipe 24 for connection to a flexible supply pipe or hose 25 wound into a number of coils 26 which are hooked to the upper wall 4 of the casing by means of a rod 27. The hose 25 is connected to the rigid pipe 24 by a special connection 28 of known type which is rapidly assembled and disassembled and closes automatically when disassembled. The hose 25 extends through the upper wall 4 of the casing in the vicinity of the middle of the length of the latter and is connected to a rigid pipe carrying a valve 30 for regulating the rate of flow. This valve 30 is secured to a T-coupling 31 whose main branch is connected to a main water supply pipe 32.

The pipes 11 supplying water to the spraying systems 10 are also connected to this main pipe 33 (FIG. 3). The distribution of water is common to the main systems 10 and to the additional water spraying elements 22 and is controlled by the same valve in the main pipe 32 (not shown). In other words, the opening and closing of the valves disposed in the main supply pipe supplies water and stops the supply of water in respect of both the systems 10 and the additional supply elements 22. The latter are also controlled by their respective valve 30.

The lower platform 3 of the casing 1 is provided with short pipes 33 for draining the cooling water sprayed onto the mould by the systems 10 and the additional water supply elements 22.

The device just described operates in the following manner:

When, for example, excessively red zones are noticed on the pipes which have just been extracted, this indicates that there is one or more abnormally hot zones in the mould 2 (which may or may not have a refractory lining) and the slides 20 are shifted along the guide bar 14 until the additional spraying elements 22 are disposed in facing relation to these zones. In the course of this displacement, the flexible coils 26 more toward or away from each other to suit the required length. With the mould 2 in rotation, the water is admitted both to the systems 10 and to the additional supply elements 22. By actuating the valves 30 water can be supplied to one or the other of the two additional water supply elements 22. When there are no abnormally hot zones, the water supplied to the elements 22 can be simply closed.

The mould 2 is consequently sprayed not only by the systems 10 but also by the additional supply elements 22 which thus afford an additional local spraying and consequently a local more pronounced cooling of the abnormally hot zones. Thus the iron cast in the mould 2 comes in contact with a mould wall or mould lining at a roughly uniform temperature and solidifies with a uniform structure.

At rest, the rapid couplings 28 can be uncoupled after having withdrawn the lateral panels of the casing. These couplings automatically close the associated pipe. The couplings 28 are hooked to the upper wall 4 of the casing by a suitable hook (not shown).

After the pins 16 have been removed, the guide bar 14 with the pipes 21 carrying the spraying elements 22 can rotate to a completely withdrawn position (FIG. 2) in which the pipes 21 bear against the lower edge of the opening 6 of the casing. In this position of rest of the device, the lateral opening 6 is open and, after having if desired disassembled the spraying systems 10, the opening 6 offers a passage for laterally withdrawing the mould 2 through the opening 6.

If the mould 2 is replaced by a mould of larger diameter, the bar 14 and its rings 17 are left in a position of the additional spraying devices which is slightly further away from the axis X—X than that shown in FIG. 2, by employing another locking aperture in the rings 17. FIG. 3 shows in full line the inoperative position of rest of the devices and in dotted lines the two possible operative positions $22^a$ and $22^b$ of the devices. Thus the bar 14, ring 17 and the locking pins 16 enable the mould spraying distance to be adjusted for the devices 22 in accordance with the diameter of the mould 2 and also allow the complete retraction of the devices 22.

By way of a modification, two guide bars 14 may be provided on each side of the mould 2, the second additional spraying assembly being identical to the first assembly shown in FIG. 3 and symmetrical with respect to the first assembly. The two assemblies are supplied by the same flexible pipe 25, which terminates for example in a tubular yoke or breeches pipe connected through a rapid coupling 28 to each bent pipe 24 located on each side of the mould 2.

Also, instead of being square, the section of the guide bar 14 may be polygonal or round and provided with a groove similar to a keyway in which slides a pin mounted on the slides 20 which are in the form of circular rings.

Also instead of completely surrounding the bar 14, the slides 20 may have an open cross section. It will be understood that, if necessary, the slides 20 may be provided with a set screw for locking the slides in position on the bar 14. A number of slides other than two may be provided on each bar 14.

An advantageous arrangement consists in providing the end of the pouring channel B with an external photoelectric cell 34 which is responsive to infrared rays and capable of detecting abnormally hot zones in the mould. This cell 34 is connected by transmission lines 35 and 36, shown in dot-dash lines in FIG. 1, to electrically-operated valves which replace the valves 30 so as to open the valves selectively in the known manner in the event of excessive heat which is manifested by an abnormally high infrared radiation. In this case the procedure is as follows:

When the operator notices on the pipe just extracted from the mould the repeated existence of one or two abnormally red zones, he disposes the slides 20 in a corresponding manner. When in the course of the rearward travel of the carriage before each following casting, the mould 2 being driven in rotation, the cell 34 scans the entire inner surface of this mould, as long as the examined zones are abnormally hot the cell commands the opening of the corresponding electrically-operated valves.

In a modification of this arrangement, corresponding to the case where a "wet spray" is sprayed into the mould by means of a gun carried either laterally by the pouring channel or by an additional rod, the cell 34 is associated with this gun in such manner as to move it away from the end of the pouring channel. Indeed, the radiation from the molten iron diminishes the sensitivity of the cell.

In accordance with a simplified arrangement, this cell may also be simply connected to a panel of light signals so as to indicate to the operator that he must actuate the additional water supply elements 22. In this case no electrically-operated valve is employed, but the valves 30 shown in FIG. 1, and the operator actuates them by hand when required.

We claim:

1. A device for cooling a rotary mould having an axis of rotation of a machine for centrifugally casting iron pipes, which machine includes means for pouring iron into the mould which pouring is accompanied by a relative axial movement between the mould and pouring means, said device comprising in combination a first cooling water supply pipe, a first valve in the first cooling water supply pipe, a cooling water spraying system connected to the first cooling water supply pipe and extending throughout a length of the mould required to be cooled and capable of supplying cooling water normally required for cooling the mould and an additional cooling water spraying means for spraying any additional localized cooling water found to be required to achieve a cooling of the mould which is substantially uniform throughout said length of the mould, said additional cooling water spraying means comprising a guide bar parallel to the axis of the mould, a slide freely slidably mounted on the bar to be movable independently of said relative movement between the mould and pouring means merely for purposes of adjustment of the slide to a desired fixed position relative to the mould axially of the mould which position remains fixed for each and during each cooling operation, a second cooling water supply pipe, a second valve in the second cooling water supply pipe, and a local cooling water spraying element carried by the slide and connected to the second cooling water supply pipe and having a length less than said length of mould required to be cooled so as to spray said additional cooling water onto only a selected fixed part of said length of the mould, which fixed part is selected by said adjustment of the slide to said desired fixed position, the second valve being operative independently of the first valve.

2. A device as claimed in claim 1, comprising a main water supply pipe, said second cooling water supply pipe being a flexible pipe connecting the main supply pipe to the local spraying element, the flexible pipe being capable of being extended in accordance with the position of the slide on the guide bar.

3. A device as claimed in claim 2, wherein the flexible pipe is wound in the form of coils and a rod parallel to the guide bar carries the coils.

4. A device as claimed in claim 2, wherein the first cooling water supply pipe is connected to the main supply pipe, which main water supply pipe comprises an inlet valve for supplying water simultaneously to the system and to the local water spraying element, the second valve being interposed between the main supply pipe and the flexible pipe.

5. A device as claimed in claim 4, wherein the second valve is a manually-operated valve.

6. A device as claimed in claim 4, wherein the second valve is an electrically-operated valve.

7. A device as claimed in claim 1, comprising pin means combined with the bar for fixing the bar in at least two angular positions about the axis of the bar.

8. A device as claimed in claim 1, wherein the guide bar has a square section.

9. A device as claimed in claim 1, comprising a plurality of said local cooling water spraying elements carried by respective slides slidably adjustable in position on the guide bar.

10. A structure comprising in combination a machine for centrifugally casting iron pipes and comprising a rotary mould having an axis of rotation, means for pouring iron into the mould which pouring is achieved by a relative axial movement between said pouring means and the mould, a device for cooling the mould, said device comprising in combination a first cooling water supply pipe, a first valve in the first cooling water supply pipe, cooling water spraying systems connected to the first cooling water supply pipe and extending throughout a length of the mould required to be cooled and capable of supplying cooling water normally required for cooling the mould and an additional cooling water spraying means for spraying any additional localized cooling water found to be required to achieve a cooling of the mould which is substantially uniform throughout said length of the mould, said additional cooling water spraying means comprising a guide bar parallel to the axis of the mould, a slide slidably mounted on the bar to be movable independently of said relative movement between the mould and pouring means merely for purposes of adjustment of the slide to a desired fixed position relative to the mould axially of the mould which position remains fixed for each and during each cooling operation, and a second cooling water supply pipe, a second valve in the second cooling water supply pipe, and a local cooling water spraying element carried by the slide and connected to the second cooling water supply pipe and having a length less than said length of mould required to be cooled so as to spray said additional cooling water onto only a selected fixed fractional part of said length of the mould, a support movable with respect to the mould, a photoelectric cell which is responsive to infrared radiations and carried by the support and directed toward the surface of the mould, said second valve means associated with the additional water spraying element for controlling the supply of water to the additional water spraying element also associated with the photoelectric cell to be controlled in accordance with the infrared radiations detected by the photoelectric cell, the second valve being operative independently of the first valve.

11. A structure as claimed in claim 10, further comprising a main water supply pipe, a flexible pipe connecting the main supply pipe to the local spraying element, the flexible pipe being capable of being extended in accordance with the position of the slide on the guide bar, the water spraying systems also being connected to the main supply pipe, which supply pipe comprises an inlet valve for supplying water simultaneously to the systems and to the local water spraying element, control means interposed between the main supply pipe and the corresponding flexible pipe being capable of separately controlling the supply of water to be local spraying element, said control means being an electrically-operated valve and the photoelectric cell being connected to the electrically-operated valve so as to open the valve automatically when the cell detects an abnormally high temperature in a zone of the mould facing the local spraying element.

12. A device for cooling a rotary mould having an axis of rotation of a machine for centrifugally casting iron pipes, which machine includes means for pouring iron into the mould, which pouring is accompanied by a relative axial movement between the mould and pouring means, said device comprising in combination a first cooling water supply pipe, a first valve in the first cooling water supply pipe, cooling water spraying systems connected to the first cooling water supply pipe and extending throughout a length of the mould required to be cooled and capable of supplying cooling water normally required for cooling the mould and an additional cooling water spraying means for spraying any additional localized cooling water found to be required to achieve a cooling of the mould which is substantially uniform throughout said length of the mould, said additional cooling water spraying means comprising a second cooling water supply pipe, a second valve in the second cooling water supply pipe, and a local cooling water spraying element connected to the second cooling water supply pipe and having a length less than said length of mould required to be cooled so as to spray water onto only a selected fixed fractional part of said length of the mould, the additional water spraying element being adjustable in position axially of the mould independently of said relative movement between the mould and said pouring means, and means operatively associated with the local water spray element for holding the local water spraying element in a fixed adjusted position axially of the mould during the cooling of the mould so that said fixed part of said length of the mould is supplied with additional water during cooling, the second valve being operative independently of the first valve.

* * * * *